US006325322B1

(12) United States Patent
Lewis

(10) Patent No.: US 6,325,322 B1
(45) Date of Patent: Dec. 4, 2001

(54) DUAL-PLATE WINDING MECHANISM WITH TENSION ADJUSTMENT

(75) Inventor: Thomas E. Lewis, East Hampstead, NH (US)

(73) Assignee: Presstek, Inc., Hudson, NH (US)

( * ) Notice: Subject to any disclaimer, the term of this patent is extended or adjusted under 35 U.S.C. 154(b) by 0 days.

(21) Appl. No.: 09/578,643

(22) Filed: May 25, 2000

Related U.S. Application Data

(60) Provisional application No. 60/157,928, filed on Oct. 6, 1999.

(51) Int. Cl.[7] ..... B65H 18/08; B41F 21/00

(52) U.S. Cl. ..... 242/538.2; 242/538.3; 101/415.1; 101/477

(58) Field of Search ..... 242/538.2, 538.3, 242/417.1, 417.3; 101/415.1, 477, 418

(56) References Cited

U.S. PATENT DOCUMENTS

| | | | | |
|---|---|---|---|---|
| Re. 36,275 | * | 8/1999 | Kusch et al. | 101/142 |
| 2,788,594 | | 4/1957 | Levander . | |
| 3,600,086 | | 8/1971 | Cates et al. | 355/16 |
| 3,941,472 | | 3/1976 | Nagahara et al. | 355/16 |
| 3,974,974 | * | 8/1976 | Nishikawa | 242/55 |
| 4,036,556 | | 7/1977 | Knight et al. | 355/14 |
| 4,057,343 | * | 11/1977 | Gontero | 355/16 |
| 4,097,138 | | 6/1978 | Kingsley | 355/3 DR |
| 4,575,890 | | 3/1986 | Hidle | 15/104 A |
| 4,803,761 | | 2/1989 | Lungers | 26/35 |
| 5,355,795 | | 10/1994 | Moss et al. | 101/141 |
| 5,413,043 | * | 5/1995 | Fuhrmann et al. | 101/415.1 |
| 5,927,196 | * | 7/1999 | Murray | 101/219 |
| 6,026,747 | * | 2/2000 | Carme et al. | 101/415.1 |

FOREIGN PATENT DOCUMENTS

| | | | |
|---|---|---|---|
| 4329125C1 | | 1/1995 | (DE) . |
| 43 29 125-C1 | * | 1/1995 | (DE) . |
| 2292341A | | 2/1996 | (GB) . |
| 2293350A | | 3/1996 | (GB) . |

* cited by examiner

*Primary Examiner*—Donald P. Walsh
*Assistant Examiner*—Joseph Rodriguez
(74) *Attorney, Agent, or Firm*—Testa, Hurwitz & Thibeault, LLP

(57) ABSTRACT

A plate material tensioning and advancement mechanism is disposed in parallel relation to a cylinder, such as a plate cylinder of a printing press, so as to separate the plate material into distinct printable sections. The plate material tensioning and advancement mechanism assists in supplying tension to the plate material via a tensioning roll during printing operation and assists in winding fresh plate material about the cylinder during advancement operation by reducing the tension on the plate material and by optionally applying tangential force to the plate material via a winding roll.

18 Claims, 5 Drawing Sheets

DUAL-PLATE WINDING MECHANISM WITH TENSION ADJUSTMENT

RELATED APPLICATION

This application claims the benefits of U.S. Ser. No. 60/157,928, filed on Oct. 6, 1999.

BACKGROUND OF THE INVENTION

1. Field of the Invention

The present invention relates to digital printing apparatus and methods, and more particularly to an apparatus for continuously supplying lithographic printing material to the plate cylinder of a planographic printing press or a plate-material imager.

2. Description of the Related Art

Traditional techniques of printing an image onto a recording medium, such as paper, include letterpress printing, gravure printing and offset lithography. All of these printing methods require the use of plate material. This plate material is loaded onto a rotating plate cylinder that is brought into pressurable contact with the recording/printing medium.

In letterpress printing, the image is represented on the plate material as raised surfaces that accept ink and transfer it onto the medium. Conversely, gravure plates define a series of wells into which the ink is deposited. Excess ink is removed from the plate material using a doctor blade or another closely contacting surface that strips excess ink from the plate material before it is brought into contact with the printing media, thereby transferring the ink to the medium.

In offset lithography, an image is defined on a printing plate defined by ink-accepting (oleophilic) areas surrounded by ink-repellent (oleophobic) surfaces. Two different lithographic systems are generally employed in offset lithography. In a dry printing system, the plate material is simply inked, and the image is transferred onto a recording/printing medium. First, the plate material makes contact with a compliant intermediate surface called a blanket cylinder which, in turn, applies the image to the paper or other medium. The paper is typically pinned to an impression cylinder in rolling contact with the blanket cylinder, which applies ink to the paper in accordance with the image.

In a wet lithographic system, the non-image areas are hydrophilic, and the necessary ink-repellency is provided by an initial application of a dampening (or "fountain") solution to the plate material prior to inking. The fountain solution prevents ink from adhering to the non-image areas but does not affect the oleophilic character of the image areas.

Many techniques have been developed for affixing plate material to underlying plate cylinders. Basic offset printing systems involve stationary clamping of a flexible length of plate material to the plate cylinder, while more advanced systems such as those described in U.S. Pat. Nos. 5,355,795 and 5,727,749 (both co-owned with the present application, and expressly incorporated herein by reference) use a relatively long length of plate material stored in the form of spools within a well in the plate cylinder. In these systems, a new segment of the plate material is advanced around the plate cylinder following completion of a print job. The new segment is imaged by an electronically controlled print head, which applies a print pattern to the surface.

It is important, during press operation, to maintain a substantial tension along the plate material that surrounds the plate cylinder. This material experiences significant tangential forces as a result of contact with the blanket cylinder, the forces resulting primarily from slight differences in the rolling diameters of the mating cylindrical surfaces, which are in contact at sufficient pressure to compress the compliant blanket cylinder surface. These forces will alter the orientation of the plate material or dislodge it completely unless the plate material is held with adequate tension against the plate cylinder. Accordingly, "payout" systems that dispense plate material from within the cylinder, must maintain strong contact between the plate material and the cylinder surface; at the same time, however, they must also allow sufficient relaxation to permit smooth supply and uptake of the material.

Typically, in order to maintain proper plate material tension during press operation, a mechanical tensioning mechanism is incorporated into the advancement system. That system includes a plate material supply spool and a take-up spool. As new plate material is needed, the take-up spool may be rotated under the action of a clutching motor while a lock (typically a ratchet and pawl assembly) is released on the supply spool, thereby allowing new plate material to be drawn therefrom. In particular, the '749 patent teaches a plate cylinder that regulates the tension of the plate material about the circumference of the cylinder. According to this patent, the plate material is advanced and tensioned by selectively locking and unlocking the supply spool while the clutching motor drives the take-up spool.

In accordance with the '749 patent, the supply spool is selectively unlocked by moving the pawl away from the ratchet to enable payout of new plate material by the supply spool. The take-up spool draws the used plate material around the cylinder until fresh material appears on the cylinder surface. The pawl is subsequently allowed to reengage the supply spool ratchet, thereby locking the supply spool to prevent further draw of plate material therefrom. The clutching motor, however, continues to drive the take-up spool, thereby creating a tension on the plate material about the circumference of the plate cylinder between the now-locked supply spool and the driven take-up spool. The tension is regulated by the preset braking torque of the clutch motor (i.e., the torque at which the clutch allows the motor to slip relative to the take-up spool drive shaft). The motor is shut off when it slips, and the thus-established tension is maintained by a one-way bearing on the take-up spool.

One potential disadvantage to the above-described system is that, during the plate-material advancement phase, tension tends to be concentrated at the take-up spool, particularly adjacent to the well in the cylinder within which the advancement mechanism resides. This results from inherent Coulomb friction generated by interaction between the back side of the plate material and the cylinder surface as the tension on the plate material is increased. It is found that this frictional resistance results even when the cylinder surface is highly polished. Indeed, the take-up spool may exert a tension roughly ten times that of the supply spool. One result of such tension is that it is difficult to control the plate material as it is advanced. In addition, the uneven tension generated adjacent the take-up spool can cause unwanted cylinder deflection. This tension imbalance also requires more powerful and, hence, larger motors and gearing for the advancement mechanism to establish a minimum tension across the entire exposed length of plate material. Another disadvantage to this type of system is the need for thick plate material capable of withstanding the tension generated by the Coulomb friction; increased thickness not only raises material costs, but limits the amount of plate material that can be accommodated within the plate cylinder.

One technique for reducing the friction (and the consequent tension in the plate is material as it is advanced around the plate cylinder) is to introduce additional pairs of supply and take-up spools. Multi-pair take-up and supply spools are described, for example, in U.S. Pat. No. 4,057,343 and in U.S. patent application Ser. No. 09/245,104 (the latter co-owned with the present application and expressly incorporated herein by reference). This approach reduces the length of plate cylinder surface over which each section of plate material must be advanced, which in turn reduces the accompanying tension in each section of plate material. Moreover, two segments of plate material are simultaneously available for imaging and printing from the same plate cylinder.

A disadvantage to this arrangement, however, is that it is mechanically complicated and expensive, requiring redundant mechanisms for proper plate material advancement. Another disadvantage is that precious space within the plate cylinder is lost in accommodating the duplicated components, resulting, once again, in a corresponding reduction in the amount of plate material that can be loaded into the plate cylinder.

DESCRIPTION OF THE INVENTION

BRIEF SUMMARY OF THE INVENTION

In accordance with the present invention there is provided a multi-function plate material tensioning and advancement assembly. The assembly employs one or more "tensioning roll" mechanisms to provide proper tension to the plate material while the plate cylinder is in printing operation.

This arrangement exposes two or more separate, opposed segments of plate material on the plate cylinder, yet utilizes a single set of supply and take-up spools. As a result, interior space within the cylinder is preserved. Additionally, the tensioning and advancement assembly of the present invention aids in the advancement of plate material about the plate cylinder by operatively reducing tension and friction on the plate material during the plate material advancement operation, and by optionally supplying additional tangential force to the plate material while it is being advanced about the plate cylinder (thereby reducing the torque required of the take-up spool to advance the plate material).

In a preferred embodiment, therefore, rotatable plate material supply and take-up spools are positioned within a first cavity of a plate cylinder, while a tensioning roll and optional advancement roll are positioned in parallel alignment with the plate cylinder.

The tensioning and advancement rolls may be disposed within a second cavity of, or substantially tangential to, the plate cylinder opposite the first cavity. The supply spool is configured to dispense plate material over a travel path around the plate cylinder, past the tensioning and optional advancement roll and onto the take-up spool. The roll (or rolls) of the invention function to apply tension once plate material has been advanced about the plate cylinder, and to either avoid interference with or actively assist as advancement takes place. If desired, additional tensioning mechanisms can be distributed (preferably evenly) about the cylinder, dividing the exposed plate material into further discrete segments.

BRIEF DESCRIPTION OF THE DRAWINGS

The foregoing discussion will be understood more readily from the following detailed description of the invention, when taken in conjunction with the accompanying drawings, in which.

DETAILED DESCRIPTION OF ILLUSTRATIVE EMBODIMENTS

Figure 1:
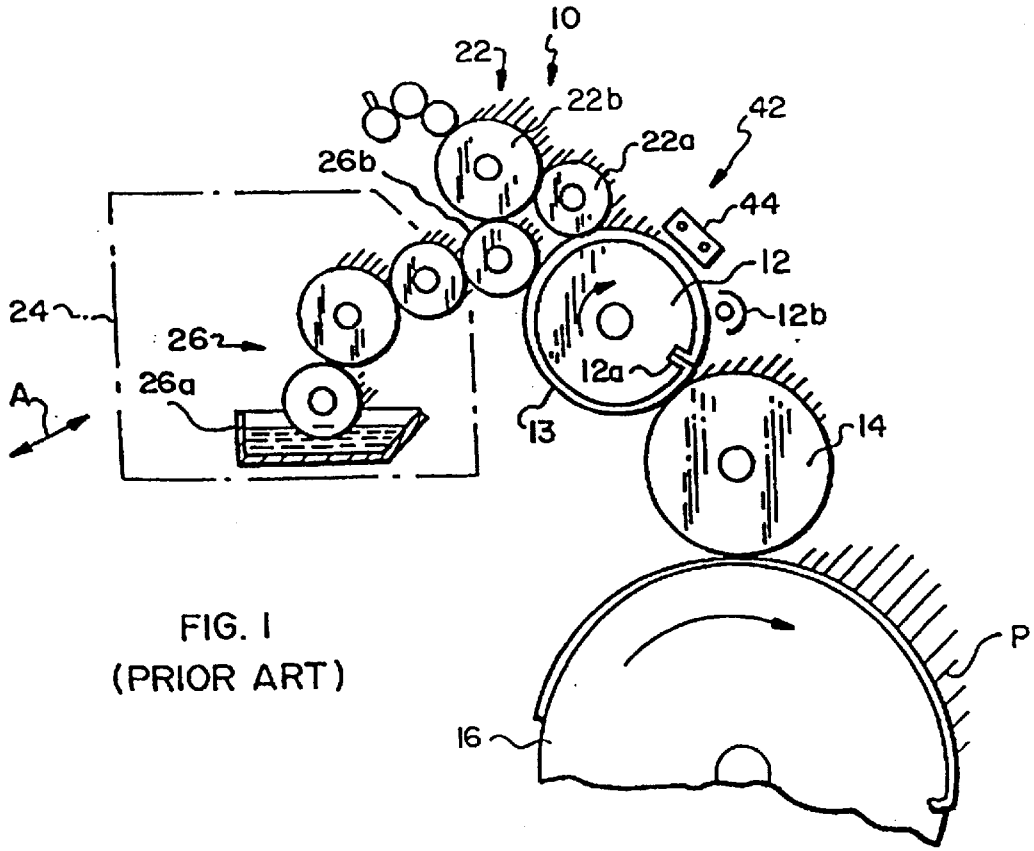
FIG. 1 (PRIOR ART)
FIG. 1 is a partial diagrammatic view of an offset press incorporating a lithographic printing plate made in accordance with this invention.

As noted previously, the invention is useful in conjunction with any type of mechanism that advances sheet or web material around a cylinder. In an exemplary embodiment, the invention is utilized in an on-press imaging environment, such as that illustrated in FIGS. 1 and 2. Refer first to FIG. 1 of the drawings, which shows a more or less conventional offset press shown generally at 10 that can print copies using lithographic plates made in accordance with this invention.

Press 10 includes a print cylinder or drum 12 around which is wrapped a lithographic plate 13 whose opposite edge margins are secured to the plate by a conventional clamping mechanism 12*a* incorporated into cylinder 12. Cylinder 12, or more precisely the plate 13 thereon, contacts the surface of a blanket cylinder 14 which, in turn, rotates in contact with an impression cylinder 16. The paper sheet P to be printed on is mounted to the surface of cylinder 16 so that it passes through the nip between cylinders 14 and 16 before being discharged to the exit end of the press 10. Ink for inking plate 13 is delivered by an ink train 22, the lowermost roll 22*a* of which is in rolling engagement with plate 13 when press 10 is printing. As is customary in presses of this type, the various cylinders are all geared together so that they are driven in unison by a single-drive motor.

The illustrated press 10 is capable of wet as well as dry printing. Accordingly, it includes a conventional dampening or fountain assembly 24 which is movable toward and away from drum 12 in the directions indicated by arrow A in FIG. 1 between active and inactive positions. Assembly 24 includes a conventional water train shown generally at 26, which conveys water from a tray 26*a* to a roller 26*b* which, when the dampening assembly is active, is in rolling engagement with plate 13 and the intermediate roller 22*b* of ink train 22.

When press 10 is operating in its dry printing mode, the dampening assembly 24 is inactive so that roller 26*b* is retracted from roller 22*b* and the plate so that no water is applied to the plate. The lithographic plate on cylinder 12 in this case is designed for such dry printing. As the cylinder 12 rotates, the plate is contacted by the ink-coated roller 22*a* of ink train 22. The areas of the plate surface that have been written on and thus made oleophilic pick up ink from roller 22*a*. Those areas of the plate surface not written on receive no ink. Thus, after one revolution of cylinder 12, the image written on the plate will have been inked. That image is then transferred to the blanket cylinder 14 and, finally to the paper sheet P which is pressed into contact with the blanket cylinder.

When press 10 is operating in its wet printing mode, the dampening assembly 24 is active so that the water roller 26*b* contacts ink roller 22*b* and the surface of the plate 13, which is intended for wet printing. It has a surface that is hydrophilic except in the areas thereof which have been written on to make them oleophilic. Those areas, which correspond to the printed areas of the original document, shun water. In this mode of operation, as the cylinder 12 rotates (clockwise in FIG. 1), water and ink are presented to the surface of plate 13 by the rolls 26*b* and 22*a*, respectively. The water adheres to the hydrophilic areas of that surface corresponding to the background of the original document and those areas, being coated with water, do not pick up ink from roller 22*a*. On the other hand, the oleophilic areas of the plate surface (which have not been wetted by roller 26) pick up ink from roller 22*a*, again forming an inked image on the surface of the plate. As before, that image is transferred via blanket roller 14 to the paper sheet P on cylinder 16.

Figure 2:
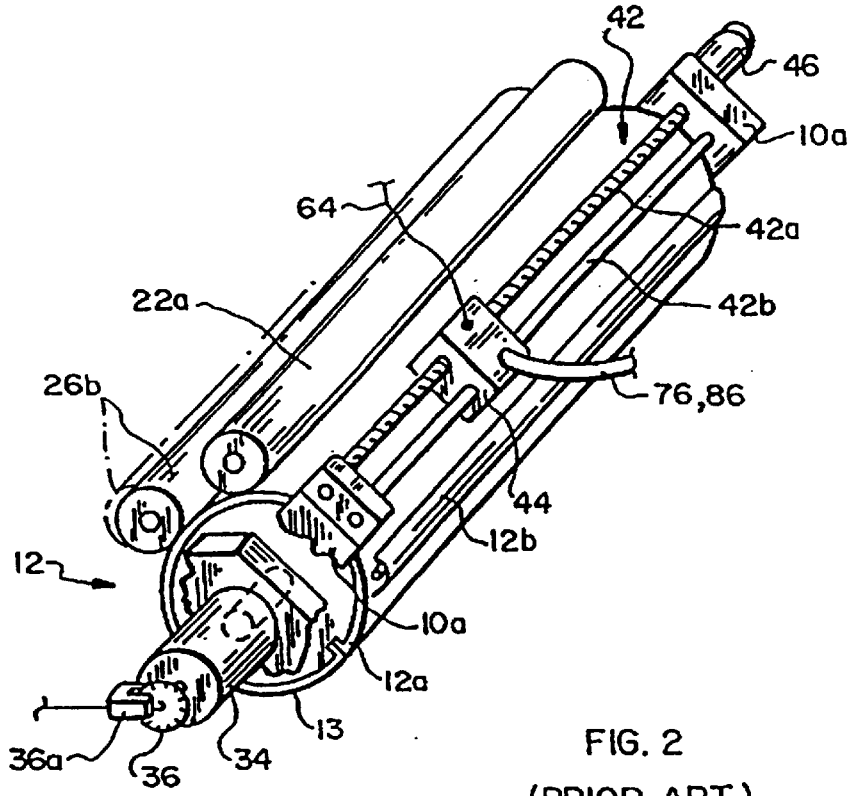
FIG. 2 (PRIOR ART)
FIG. 2 is an isometric view on a larger scale showing in greater detail the plate cylinder portion of the FIG. 1 press.

While the image to be applied to the lithographic plate 13 can be written onto the plate while the plate is "off press," the present invention lends itself to imaging of a plate already mounted on the print cylinder 12. As shown in FIG. 2, the print cylinder 12 is rotatively supported by the press frame 10*a* and rotated by a standard electric motor 34 or other conventional means. The angular position of cylinder 12 is monitored by conventional means such as a shaft encoder 36 that rotates with the motor armature and associated detector 36*a*.

Also supported on frame 10*a* adjacent to cylinder 12 is a writing head assembly shown generally at 42. This assembly comprises a lead screw 42*a* whose opposite ends are rotatively supported in the press frame 10*a*, which frame also supports the opposite ends of a guide bar 42*b* spaced parallel to lead screw 42*a*. Mounted for movement along the lead screw and guide bar is a carriage 44. When the lead screw is rotated by a step motor 46, carriage 44 is moved axially with respect to print cylinder 12. The cylinder drive motor 34 and step motor 46 are operated in synchronism by a controller (not shown), which also receives signals from detector 36*a*, so that as the drum rotates, the carriage 44 moves axially along the drum with the controller "knowing" the instantaneous relative position of the carriage and cylinder at any given moment. The control circuitry required to accomplish this is very well known in the scanner and plotter art; see also U.S. Pat. No. 5,174,205.

Figure 3:
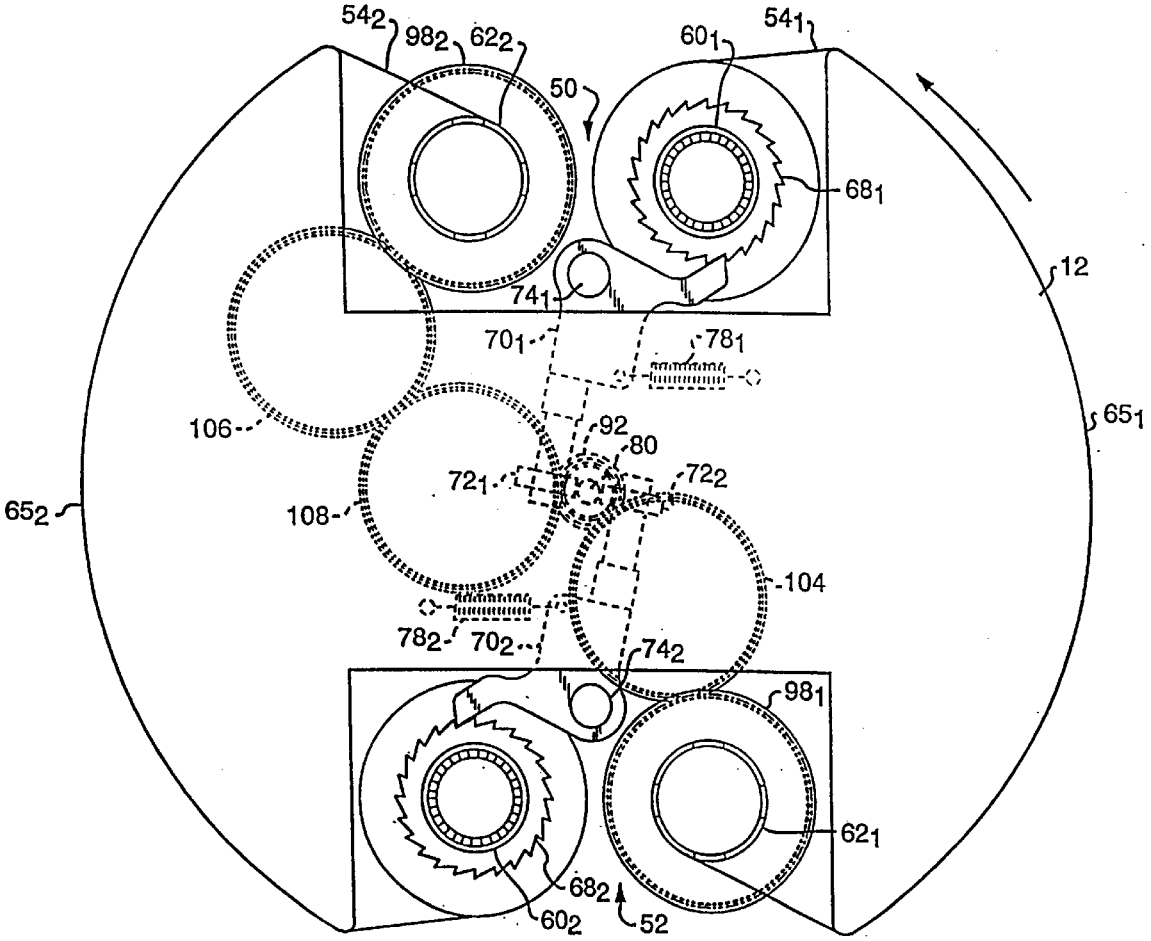
FIG. 3 (PRIOR ART)
FIG. 3 is an end view of a plate cylinder employing a dual-plate material configuration with diametrically opposed printing segments, showing two pairs of supply and take-up components distributed in opposed cavities of the plate cylinder.

As discussed above, the plate may take the form of a rolled supply of material stored within cylinder 12 (in contrast to the traditional sheet configuration that must be individually wrapped around the cylinder). Moreover, multiple continuous supplies of plate material may be utilized, to reduce the frictional forces exerted on the plate material by the plate cylinder and to provide for multiple printing sections. FIG. 3 illustrates the components of a prior-art plate material supply and take-up apparatus, which is adapted for a dual-plate configuration with diametrically opposed printing segments. The benefits of the present invention will be apparent when compared to this prior-art device.

With reference to FIG. 3, the plate material supply and take-up components are located in a pair of opposed cavities 50, 52 within cylinder 12. A first segment $\mathbf{54}_1$ of plate (or other recording) material wraps around a portion of the surface of cylinder 12, extending from a supply spool $\mathbf{60}_1$ rotatable within cavity 50 to a take-up spool 62 rotatable within cavity 52. Accordingly, rotation of the take-up spool $\mathbf{62}_1$ causes supply spool $\mathbf{60}_1$ to dispense recording material over a travel path extending around a portion $\mathbf{65}_1$ of cylinder 12, from cavity 50 to cavity 52.

A second segment $\mathbf{54}_2$ of plate material wraps around an opposed portion of the surface of cylinder 12, extending from a supply spool $\mathbf{60}_2$ rotatable within cavity 52 to a take-up spool $\mathbf{62}_2$ rotatable within cavity 50. The travel path of segment $\mathbf{54}_2$ extends around a portion $\mathbf{65}_2$ of cylinder 12, from cavity 52 to cavity 50.

In this configuration, each supply spool $\mathbf{60}_1$, $\mathbf{60}_2$ contains a respective ratchet $\mathbf{68}_1$, $\mathbf{68}_2$. A pair of pawls $\mathbf{70}_1$, $\mathbf{70}_2$, each having a respective cam follower $\mathbf{72}_1$, $\mathbf{72}_2$ extending therefrom, are rotatable about respective pivots $\mathbf{74}_1$, $\mathbf{74}_2$. The tooth of each pawl $\mathbf{70}_1$, $\mathbf{70}_2$ engages the corresponding ratchet $\mathbf{68}_1$, $\mathbf{68}_2$. A pawl spring $\mathbf{78}_1$, $\mathbf{78}_2$, extending between the arm of pawl $\mathbf{70}_1$, $\mathbf{70}_2$ and a point within plate cylinder 12 that remains stationary with respect to pawl $\mathbf{70}_1$, $\mathbf{70}_2$, urges the pawl against the corresponding ratchet $\mathbf{68}_1$, $\mathbf{68}_2$.

Operation of the plate winding mechanisms of this device is as follows. Ordinarily a central shaft rotates cylinder 12 while gears 98, 104, 106, and 108 remain stationary with respect to the central shaft; the drive shaft is geared to a brake (not shown) by means of a central gear 92, which surrounds the central shaft. At this point, the brake offers no resistance to the rotation of cylinder 12. To cause plate material to be wound onto, for example, take-up spool $\mathbf{62}_1$, an operator notifies a controller, which causes retraction of a cam shaft, thereby disengaging pawl $\mathbf{70}_1$, and releasing supply spool $\mathbf{60}_1$. The controller also engages the brake, which arrests rotation of the central shaft. Cylinder 12 continues to rotate, however; assuming counterclockwise rotation (as indicated by the arrow in FIG. 3) and with central gear 92 now rendered stationary, rotation of cylinder 12 causes intermediate gear 104 to rotate about the central gear 92 as a "planetary gear," turning take-up gear $\mathbf{98}_1$ in a clockwise direction to draw plate material from supply spool $\mathbf{60}_1$ (itself now free to rotate due to disengagement of pawl $\mathbf{70}_1$). Reverse rotation of take-up spool $\mathbf{62}_1$ is prevented by a one-way clutch.

Figure 4:
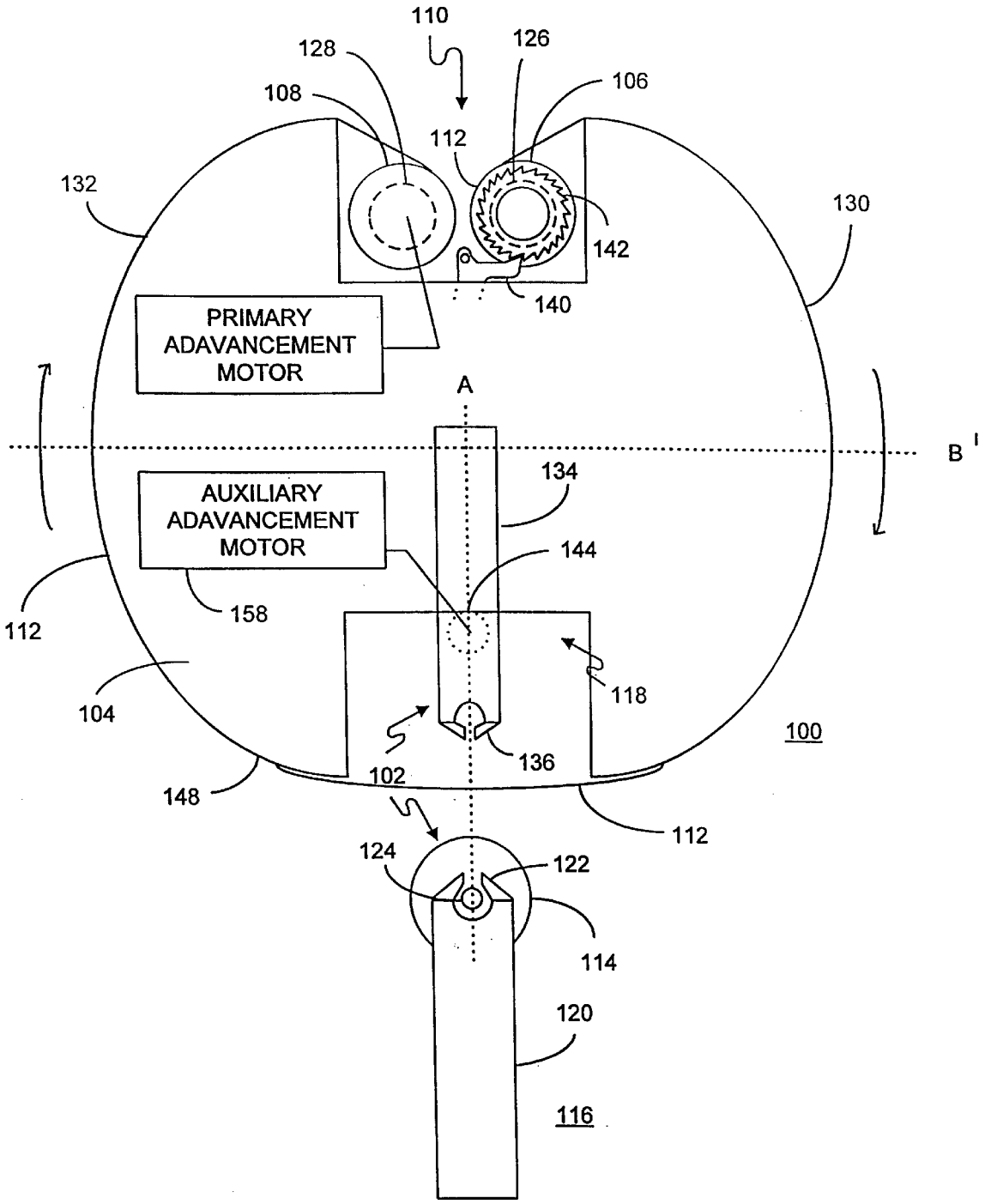
FIG. 4 is a side view of a plate cylinder containing the components of the present invention.
Figure 5:
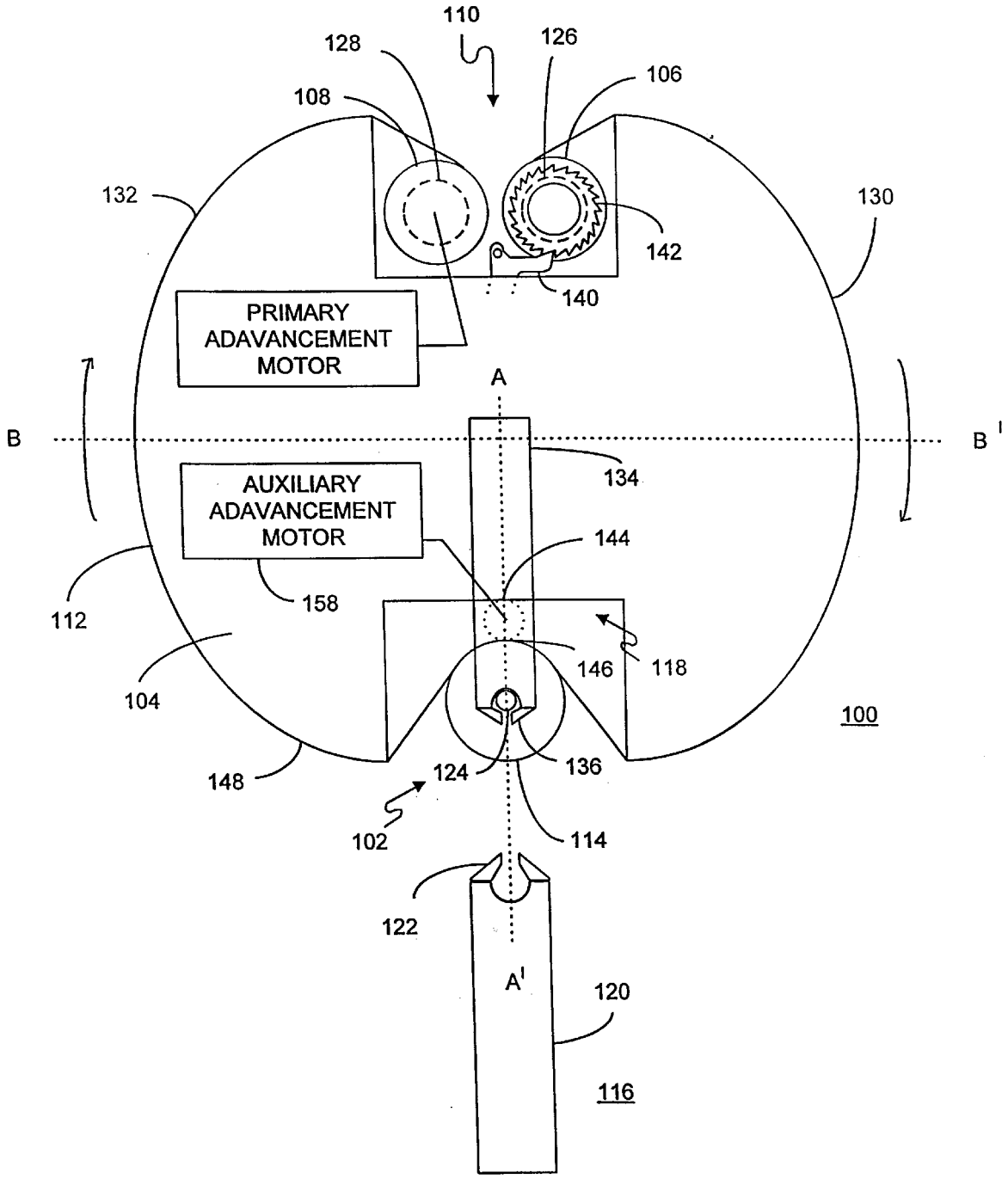
FIG. 5 is a side view of the plate cylinder of FIG. 4, showing a different component configuration.

The present invention provides an alternative approach to advancement and tensioning of multiple segments of plate material. FIGS. 4 and 5 illustrate the primary components of a first embodiment of the invention, which is adapted for a dual-plate material segment configuration with opposed printing segments. It should be recognized, however, that this configuration is exemplary only; the present invention can include more than a single pair of take-up and supply spools and/or more than a single tensioning and advancement mechanism distributed evenly or otherwise around the cylinder.

As discussed above, it is important, during press operation, to maintain a substantial tension along the plate material that surrounds the plate cylinder. With reference to FIG. 4, an auto-loading plate cylinder assembly 100 incorporates a tensioning and advancement assembly indicated generally at 102. The auto-loading plate cylinder assembly 100 includes a plate cylinder 104, a set of rotatable supply and take-up spools 106, 108, disposed within a cavity 110, and a supply of plate material 112. The tensioning and advancement assembly 102 includes a tensioning roll 114 that maintains tension on the plate material 112 during press operation.

To properly tension plate material 112 prior to press operation, a transport mechanism 116 maneuvers tensioning roll 114 into a cavity 118 of plate cylinder 104 along the axis A–A'. Transport mechanism 116 comprises a pair of brackets (one of which is shown at 120) disposed alongside opposite ends of cylinder 104. Each bracket has a clamp 122 that releasably grips a shaft or stem 124 projecting from one of the end faces of roll 114.

As tensioning roll 114 is maneuvered into plate cylinder 104, it contacts the plate material 112 that is covering cavity 118. Plate material is driven into cavity 118 (see FIG. 5), increasing the tension on the plate material 112 about plate cylinder 104 from both sides of the midpoint (with respect to the axis B–B'). One or more drag mechanisms 126, 128 may be attached to supply and or take-up spools 106, 108, respectively. Drag mechanisms 126, 128 allow either or both of the supply and take-up spools 106, 108 to pay out additional plate material 112 when tensioning roll 114 is inserted into cavity 118. This prevents the plate material 112 from becoming overly tensioned, which might result in unwanted deformation or rupturing of plate material 112. The drag mechanisms 126, 128, such as those described in U.S. Pat. Nos. 5,358,196 and 5,740,975, can be set to release a pre-set amount of additional plate material as roll 114 travels into cavity 118, the pre-set amount being determined by the nature of the plate material and the inward distance traveled by roll 114.

Tensioning plate material 112 in this way requires less torque on the take-up spool 108 than is imposed by prior-art advancement systems. As a result, the force applied to tighten the plate material 112 about cylinder portions 130, 132 is distributed more evenly over the entire exposed portion of plate material 112, allowing for the use of thinner plate material. This means that more plate material 112 may be loaded onto supply spool 108. Additionally, the drag feature of the present invention allows spooling of plate material 112 about plate cylinder 104 without requiring an initial payout of excess plate material 112 to accommodate the introduction of tensioning roll 114. This feature reduces the chance of any excess plate material 112 lifting off plate cylinder 104 and adversely contacting other parts of the press assembly.

Referring now to FIG. 5, tensioning roll 114 is inserted into cavity 118 by inward translation of transport mechanism 116. A stationary gripping mechanism comprises a pair of brackets (only one of which is illustrated at 134) spaced apart and aligned with the brackets of transport mechanism 116. Each bracket 134 has a releasable clamp 136. Transport mechanism hands off roll 114 so that the stems 124 thereof pass from clamps 122 to clamps 136, in the process driving plate material 112 inward. As a result, the travel path of plate material 112 extends from supply spool 106 around a first circumferential portion 130 of plate cylinder 104, past tensioning roll 114, around a second circumferential portion 132 of plate cylinder 104, and onto take-up spool 108. The exposed portions of the plate material along cylinder portions 130, 132 are each simultaneously available for imaging and subsequent printing operations. As discussed above, the ability to maintain separate printing segments using a single set of supply and take-up spools represents a substantial advantage of the present invention.

During press operation, brackets 134 maintain the tensioning roll 114 at a fixed position within cavity 118. When a printing cycle is completed (or if the plate material 112 must otherwise be advanced), the tensioning roll 114 is released by brackets 134 into transport mechanism 116 and maneuvered away from the plate cylinder 104, and hence away from plate material 112, by transport mechanism 116 along axis A–A', thereby easing the tension on plate material 112.

After tensioning roll 114 is removed from plate cylinder 104, fresh plate material 112 may be advanced around plate cylinder 104 in much the same way as it is in the prior-art mechanism described above. First, a pawl 140 is disengaged from a ratchet 142, thereby allowing supply spool 106 to pay out plate material 112. A shaft and gear system, similar to that of the prior art, may be used to wind plate material 112 onto take-up spool 108. Once the plate material has been sufficiently advanced, transport mechanism 116 reinserts the tensioning roll 114 into brackets 134, thereby retensioning plate material 112 about plate cylinder 104. An advantage to this embodiment is the absence of contact between tensioning roll 114 and the outer surface of plate material 112 during advancement. Because the segment of plate material along cylinder portion 130 will have been inked during use, retraction of roll 114 away from cylinder 104 prevents this ink from contaminating the surface of roll 114.

In an alternative embodiment of the present invention, the tensioning roll 114 is held in place by the brackets 134 during the plate-advancement stage, rather than being transferred to the transport mechanism 116. An advancement roll 144 (see FIG. 4), may be used in conjunction with the tensioning roll 114 to assist in advancing plate material 112 about plate cylinder 104. Advancement roll 144 is positioned in parallel alignment with tensioning roll 114, so that a nip 146 is created between the two rolls 114, 144. Nip 146 has sufficient width to accommodate plate material 122.

To assist the take-up roll 108 in advancing plate material 112 about plate cylinder 104, the advancement roll 144 may be rotated by an auxiliary advancement motor 158. Rotation of advancement roll 144 creates a tangential force between tensioning roll 114 and advancement roll 144, which acts on plate material 112 at nip 146. The additional tangential force exerted by the tensioning and advancement rolls 114, 144, allows plate material 112 to be advanced around plate cylinder 104 with less force from the take-up spool 108, which reduces the overall tension experienced by plate material 112 during advancement. In this embodiment, the force exerted by the tensioning and advancement rolls 114, 144 operates to tension plate material 112 about section 130 of the plate cylinder, while the take-up spool 108 operates to tension plate material 112 about section 132 of the plate cylinder. Obviously, this configuration requires continuous contact between the exterior surface of plate material 112 and tensioning roll 114. Transfer of residual ink to roll 114 can be minimized by employing, on the surface of roll 114, a release material (such as silicone or a fluoropolymer, and preferably, for durability, a fluoropolymer composite material) to which ink will not adhere. Alternatively, plate material 112 can be cleaned prior to advancement.

Figure 6:
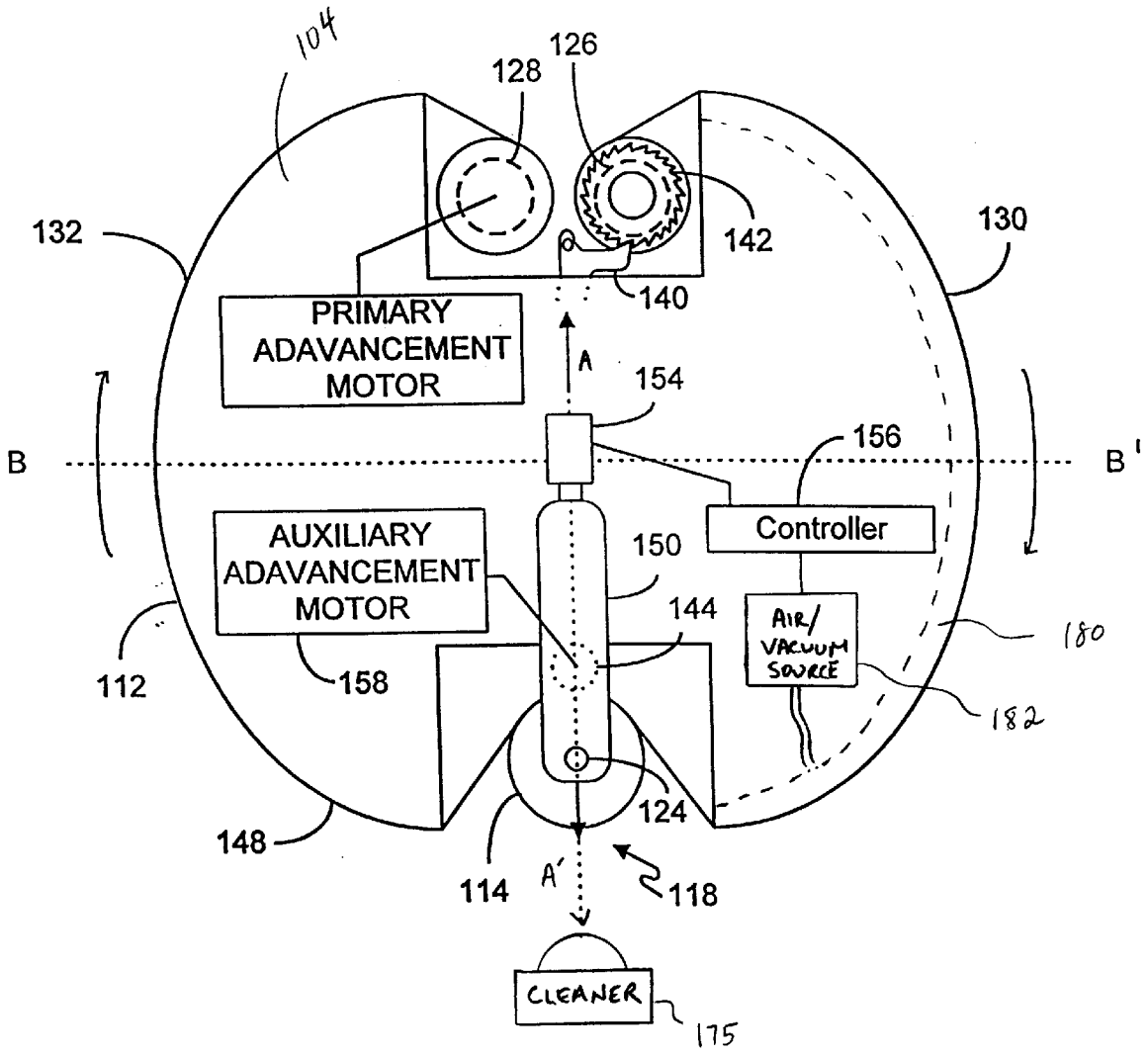
FIG. 6 is a side view of a plate cylinder assembly containing the components of an alternative embodiment of the present invention.

FIG. 6 illustrates an alternative embodiment wherein tensioning roll 114 is maintained in a "dancing roll" configuration. In this embodiment, tensioning roll 114 and an optional advancement roll 144 may be held stationary within cavity 118 in plate cylinder 104, or more preferably they may be allowed to move axially along A–A', perpendicularly to the circumference 148 of plate cylinder 104 to adjust the tension on plate material 112. A pair of positioning arms (one of which is shown at 150) hold tensioning roll 114 and optional advancement roll 144 in parallel alignment with plate cylinder 104. A pair of pneumatic or hydraulic piston devices (one of which is shown at 154) operate to control the radial location of positioning arms 150 along the axis A–A'.

A controller 156 governs the movement of piston devices 154. During a plate-material advancement cycle, controller 156 operates pistons 154 to maneuver tensioning and advancement rolls 114, 144 outwardly along the axis A–A', away from the center of plate cylinder 104. As tensioning and advancement rolls 114, 144 are maneuvered outward, the tension on plate material 112 is reduced, which results in a reduction of the frictional forces between plate cylinder 104 and plate material 112.

As noted above, contact between roll 114 and the inked surface of plate material 112 can result in unwanted transfer of ink onto roll 114, and the illustrated embodiment reflects yet another approach toward minimizing this problem: the use of a cleaner 175, which may include, for example, a rotating brush roller (see, e.g., U.S. Pat. No. 5,870,954, hereby incorporated by reference) or a moistened, advanceable towel (see, e.g., U.S. Pat. No. 5,755,158, also incorporated by reference, particularly with respect to cleaning device 20), or other suitable device. Radial movement of roll 114 during advancement brings it into rolling engagement with cleaning device 175, so that ink transferred onto roll 114 is immediately removed.

Also as discussed above, advancement roll 144 may be driven by the auxiliary advancement motor 158 to aid in the advancement of plate material 112. Still another expedient to facilitate plate advancement is the use of a porous cylinder surface along sections 130, 132. By forcing air through the pores during advancement, an air cushion is formed that substantially reduces friction between plate material 112 and the cylinder surfaces. This is facilitated by forming a pair of annular air chambers (only one of which is illustrated at 180) within cylinder 104 and coextensive with sections 130, 132. An airhandling unit 182, the operation of which is managed by controller 156, supplies air into the annular chambers during advancement. The resulting reduction in friction facilitates use of thinner plate material 112 and dimensionally wider plate sizes.

After the plate-material advancement stage is completed, the controller 156 sends a signal to piston devices 154 to retract positioning arms 150 inwardly, which draws tensioning roll 114 against plate material 112, thereby tensioning the plate material in much the same manner as in the above-described first embodiment. Moreover, if unit 182 can alternatively be operated to supply a vacuum, the plate material 112 can be drawn by suction into solid contact with sections 130, 132 following advancement. Again, the timing and direction of the air-handling operation is managed by controller 156.

Finally, it is possible to utilize a compressible surface for sections 130, 132 to permit direct printing (i.e., plate-to-paper, rather than via a blanket cylinder).

It will therefore be seen that we have developed a reliable and convenient mechanism for tensioning, advancing, dispensing and receiving material that wraps around a cylinder, and which is especially suited to lithographic printing systems. The terms and expressions employed herein are used as terms of description and not limitation, and there is no intention, in the use of such terms and expressions, of excluding any equivalents of the features shown and described or portions thereof, but it is recognized that various modifications are possible within the scope of the invention.

What is claimed is:

1. Apparatus for alternatively tensioning and advancing plate material about a cylinder having an interior, the apparatus comprising:

a. a tensioning roll secured in parallel alignment with the cylinder;

b. a translation mechanism for alternatively causing inward or outward movement of the tensioning roll along a radial axis of the cylinder; and c. at least one winding mechanism comprising a supply spool and a take-up spool the supply spool being configured to dispense a rolled supply of plate material over a travel path extending around a first circumferential section of the cylinder, over the tensioning roll, around a second circumferential section of the cylinder and onto the take-up spool, the take-up spool being configured to permit winding of dispensed plate material therearound, the tensioning roll engaging the plate material whereby movement of the tensioning roll into the interior of the cylinder applies tension to the plate material.

2. The apparatus of claim 1 wherein the translation mechanism is a dancing-roll assembly associated with the tension roll.

3. The apparatus of claim 1 further comprising a winding roll in parallel alignment with the tensioning roll and forming a nip therebetween such that rotation of the winding and tensioning rolls advances plate material through the nip.

4. The apparatus of claim 1 wherein the cylinder has an interior and further comprising a gripping mechanism connected to the cylinder for releasably securing the tensioning roll within interior of the cylinder.

5. The apparatus of claim 1 wherein at least one of the supply spool and the take-up spool comprises a drag mechanism for releasing a predetermined amount of plate material when tension is applied to the plate material by the tensioning roll.

6. The apparatus of claim 1 further comprising means for creating an air cushion over the first and second circumferential cylinder sections during winding.

7. The apparatus of claim 2 wherein the dancing-roll assembly comprises a pair of pistons and a controller for operating the pistons.

8. The apparatus of claim 2 further comprising a cleaner in rolling contact with the tensioning roll when the tensioning roll is translated radially outward, thereby facilitating cleaning of the tensioning roll as plate material is advanced around the travel path.

9. The apparatus of claim 4 wherein the gripping mechanism comprises a pair of gripping arms for releasably gripping the tensioning roll.

10. The apparatus of claim 4 wherein the transport mechanism controls the position of the tensioning roll with respect to the cylinder, the transport mechanism alternatively (i) driving the tensioning roll into the interior of the cylinder, thereby applying tension to the plate material, and handing off the tensioning roll to the gripping mechanism, or (ii) receiving the tensioning roll from the gripping mechanism and transporting the tensioning roll out of the interior of the cylinder.

11. The apparatus of claim 6 further comprising means for creating suction over the first and second circumferential cylinder sections following winding so as to secure the plate material to the surfaces.

12. A system for alternatively tensioning and advancing plate material about a plate cylinder, the plate cylinder having a first cavity and a second cavity located in opposite regions about the circumference of the cylinder, the system comprising:

a. a transport mechanism for transporting a tensioning roll radially into and out of the first cavity of the plate cylinder;

b. a gripping mechanism for retaining the tensioning roll in the first cavity in secure parallel alignment with the plate cylinder; and c. a supply spool and a take-up spool, both disposed within the second cavity, the supply spool dispensing a rolled supply of plate material over a travel path extending around a first circumferential section of the cylinder, over the tensioning roll, around a second circumferential section of the cylinder and onto the take-up spool, the take-up spool winding dispensed plate material therearound, whereby movement of the tensioning roll into the first cavity applies tension to the plate material due to extension of the travel path over the tensioning roll.

13. The system of claim 8 further comprising a winding roll in parallel alignment with the tensioning roll and forming a nip therebetween such that rotation of the winding and tensioning rolls advances plate material through the nip and around the plate cylinder.

14. A method for tensioning recording material about a cylinder having an interior, the method comprising the steps of:

a. providing a supply spool and take-up spool in the interior of the cylinder;

b. from the supply spool, dispensing a rolled supply of recording material over a travel path extending around a first circumferential section of the cylinder, across an opening to the interior of the cylinder, around a second circumferential section of the cylinder and onto the take-up spool; and c. inserting and securing a tensioning roll radially with respect to the cylinder into the interior thereof through the opening, thereby tensioning the recording material to the first and second circumferential sections of the cylinder.

15. The method of claim 14 wherein the recording material is advanced around the cylinder by first removing the tensioning roll from the cylinder interior, thereby reducing the tension on the recording material.

16. The method of claim 14 further comprising the step of cleaning the tensioning roll as plate material is advanced around the travel path, the tensioning roll being in contact with the plate material as it is dispensed.

17. The method of claim 14 further comprising the step of creating an air cushion over the first and second circumferential cylinder sections during winding.

18. The method of claim 14 further comprising the step of creating suction over the first and second circumferential cylinder sections following winding so as to secure the plate material to the surfaces.

* * * * *